US005709157A

United States Patent [19]

Hanusiak

[11] Patent Number: 5,709,157

[45] Date of Patent: Jan. 20, 1998

[54] SLIDABLE LOCKING MECHANISM FOR SUPPORTING A DROP-LEAF TABLE EXTENSION

[75] Inventor: Tadeusz J. Hanusiak, 6825 W. Talcott Ave., Chicago, Ill. 60656

[73] Assignee: Tadeusz J. Hanusiak, Chicago, Ill.

[21] Appl. No.: 613,596

[22] Filed: Mar. 12, 1996

[51] Int. Cl.[6] ..... A47B 1/04

[52] U.S. Cl. ..... 108/78; 108/69

[58] Field of Search ..... 108/69, 75, 78, 108/77, 70, 71, 72, 73; 16/361, 362, 360, 239, 235

[56] References Cited

U.S. PATENT DOCUMENTS

| | | | |
|---|---|---|---|
| 490,473 | 1/1893 | Cornell | 108/79 |
| 1,662,228 | 3/1928 | Anderson | 108/78 |
| 1,709,210 | 4/1929 | Gillespie | 108/77 |
| 2,560,821 | 7/1951 | Rieman et al. | 108/78 |
| 2,685,488 | 8/1954 | Duncan . | |
| 2,731,317 | 1/1956 | Duncan | 108/78 |
| 2,907,616 | 10/1959 | Sullivan | 311/60 |
| 3,336,881 | 8/1967 | Aiken, Sr. | 108/77 |
| 4,301,744 | 11/1981 | Walter | 108/77 |
| 4,606,279 | 8/1986 | Tucker et al. | 108/78 |
| 4,646,654 | 3/1987 | Sullivan | 108/69 |
| 4,735,151 | 4/1988 | Bisbing | 108/69 |

FOREIGN PATENT DOCUMENTS

| | | | |
|---|---|---|---|
| 581417 | 8/1959 | Canada | 108/78 |
| 180923 | 11/1935 | Switzerland | 108/69 |
| 278866 | 10/1927 | United Kingdom | 108/69 |
| 789624 | 1/1958 | United Kingdom | 108/78 |

*Primary Examiner*—Jose V. Chen

*Attorney, Agent, or Firm*—Wallenstein & Wagner, Ltd.

[57] ABSTRACT

A self-contained slidable locking mechanism for supporting a drop-leaf table extension to a tabletop, the mechanism comprising a catch plate having material removed to define an elongated groove, an elongated slidable support bar having first and second ends, a hook member attached at the first end and a stop pin extending outwardly from a first surface of the support bar, the stop pin slidably engaged within the elongated groove of the catch plate and, an elongated retainer sleeve which receives the support bar, the retainer sleeve and the catch plate forming a housing within which the slidable support bar reciprocates from an extended position to a retracted position, where in the extended position the second end of the slidable support bar extends from the housing and supports the drop-leaf table extension in a horizontal position and when in the retracted position the hook member locks the drop-leaf table extension in a folded position, the housing being adapted to be mounted to the underside of the tabletop.

18 Claims, 2 Drawing Sheets

SLIDABLE LOCKING MECHANISM FOR SUPPORTING A DROP-LEAF TABLE EXTENSION

TECHNICAL FIELD

The present invention relates to a slidable locking mechanism which is mounted to an underside of a tabletop for supporting a drop-leaf table extension, and particularly, to tables employing the slidable locking mechanism.

BACKGROUND OF THE INVENTION

The use of extension leaves to enlarge or otherwise alter the size and shape of a tabletop is well known in the art. Commonly, such extension leaves are mounted to the bottom surface of a tabletop, at an outermost edge of the tabletop, via a hinged device. This allows for the extension leaf to hang in a vertical position below the tabletop when the extension leaf is not in use. In many cases this is undesirable because such a storage position interferes with the seating comfort in the area of the extension leaf and also makes accessibility to the table virtually impossible for the handicapped. Examples of such prior extension leaf assemblies are disclosed in U.S. Pat. Nos. 4,301,744 and 4,606,279.

A number of latch hinge assemblies have been proposed which allow the extension leaf to be stored in a horizontal position beneath the tabletop. In such assemblies, the extension leaf is not directly connected to the tabletop by a hinge. Instead, the extension leaf is connected near the central portion of its bottom surface to a telescopic hinge which extends outwardly from the underside of the tabletop. When the telescopic hinge is fully extended, the extension leaf is rotatable 180° about its center point so that in the use position the extension leaf is supported by the fully extended telescopic hinge and rests adjacent the outer edge of the tabletop. Examples of such latch hinge assemblies are disclosed in U.S. Pat. Nos. 4,646,654 and 4,735,151.

Latch hinge assemblies which include telescopic hinge mechanisms generally require a plurality of intricately fitting, slidable parts. These parts must be fabricated from a material which can be machined with precision, yet resist wear. This adds not only to the cost of the assembly, but also to the ease of installation. Further, latch hinge assemblies which rotate about the center of the extension leaf require an additional mechanism to prevent reverse rotation of the extension leaf once it is in the use position. Further, latch hinge assemblies generally cannot be retrofitted to existing tabletops without some type of modification or machining of the existing tabletop.

SUMMARY OF THE INVENTION

In view of the foregoing, it is therefore an object of the present invention to provide a self-contained slidable locking mechanism for supporting a drop-leaf table extension which permits storage of the drop-leaf extension in a position beneath and parallel with the underside of a tabletop or countertop. It is another object of the present invention to provide a self-contained slidable locking mechanism for supporting a drop-leaf table extension which can be manufactured from low cost materials and by a high-production, non-labor intensive process which reduces the cost of the mechanism. It is yet another object of the present invention to provide a self-contained slidable locking mechanism for supporting a drop-leaf table extension which is easy to assemble and install, and which can be retrofitted to existing tabletops or countertops without any machining or extensive modifications to the existing tabletops or countertops.

According to a first aspect of the present invention, there is provided a self-contained slidable locking mechanism for supporting a drop-leaf table extension to a tabletop. The mechanism comprises a catch plate having material removed to define an elongated groove, an elongated slidable support bar having first and second ends, and an elongated retainer sleeve which receives the slidable support bar. A hook member is attached at the first end of the support bar and a stop pin extends outwardly from a first surface of the support bar. The stop pin is slidably engaged within the elongated groove of the catch plate. The elongated retainer sleeve and the catch plate form a housing within which the slidable support bar reciprocates from an extended position to a retracted position. When the support bar is in the extended position, the second end of the slidable support bar extends from the housing and supports the drop-leaf table extension in a horizontal position. When the support bar is in the retracted position, the hook member locks the drop-leaf table extension in a folded position. The housing is adapted to be mounted to the underside of the tabletop.

According to a second aspect of the present invention, there is provided a table comprising a tabletop, at least one drop-leaf table extension connected to the tabletop, a catch plate having material removed to define an elongated groove, an elongated slidable support bar having first and second ends, and an elongated retainer sleeve which receives the slidable support bar. A hook member is attached at the first end of the support bar and a stop pin extends outwardly from a first surface of the support bar. The stop pin is slidably engaged within the elongated groove of the catch plate. The elongated retainer sleeve and the catch plate form a housing within which the slidable support bar reciprocates from an extended position to a retracted position. When the support bar is in the extended position, the second end of the slidable support bar extends from the housing and supports the drop-leaf table extension in a horizontal position. When the support bar is in the retracted position, the hook member locks the drop-leaf table extension in a folded position. The housing is adapted to be mounted to the underside of the tabletop.

Other advantages and aspects of the present invention will become apparent upon reading the following description of the drawings and detailed description of the present invention.

DETAILED DESCRIPTION OF THE INVENTION

Figure 1:
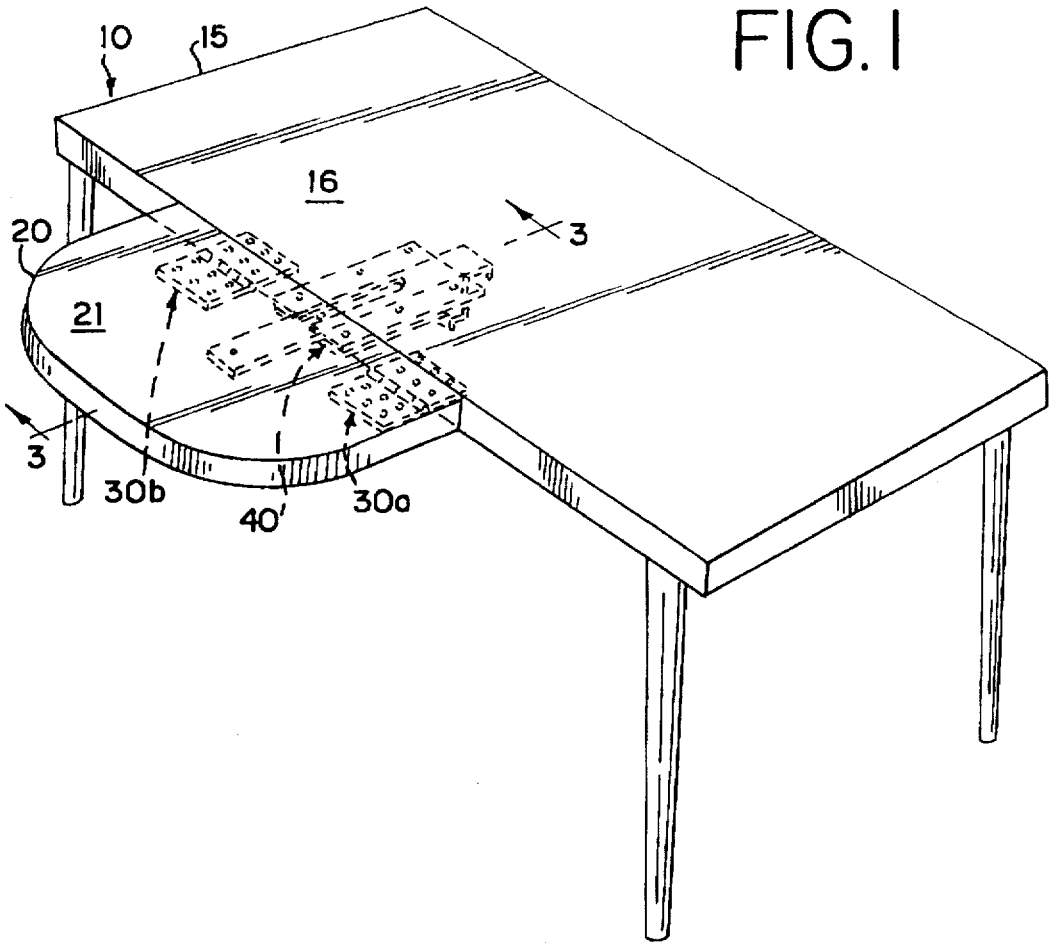
FIG. 1 is a perspective view of a table according to the present invention.

While this invention is susceptible of embodiment in many different forms, there is shown in the drawings and will herein be described in detail preferred embodiments with the understanding that the present disclosure is to be considered as an exemplification of the principles of the invention and is not intended to limit the broad aspect of the invention to the embodiments illustrated.

Referring now to FIG. 1, there is illustrated a table 10 having a tabletop 15 and a drop-leaf table extension 20. Disposed beneath the tabletop 15 and the drop-leaf table extension 20 are a pair of hinges 30*a*, 30*b* (shown in dashed line form) which connect the tabletop 15 and the drop-leaf table extension 20. Also disposed beneath the tabletop 15 and the drop-leaf table extension 20 is a slidable locking mechanism 40 (also shown in dashed line form). The slidable locking mechanism 40 supports the drop-leaf table extension 20 in a horizontal position.

Figure 2:
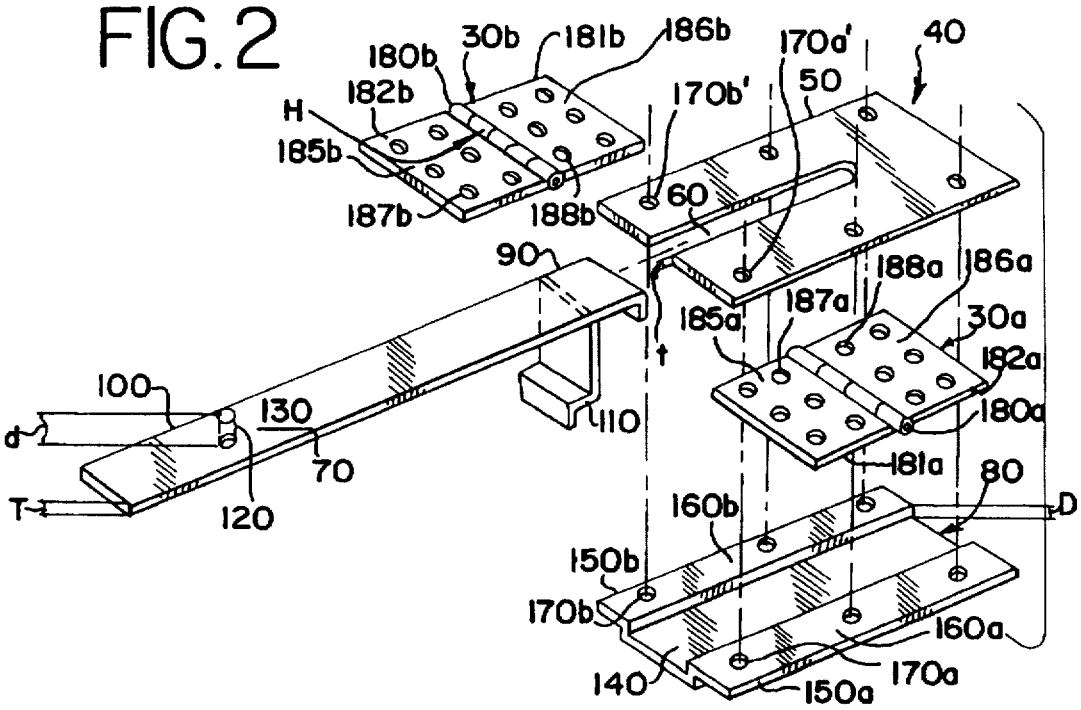
FIG. 2 is an exploded perspective view of a slidable locking mechanism for supporting a drop-leaf table extension to a tabletop according to the present invention.

With reference to FIG. 2, the slidable locking mechanism 40 is comprised of a catch plate 50 having material removed to define a groove 60, an elongated slidable support bar 70, and an elongated retainer sleeve 80. The support bar 70 has first and second ends 90, 100. A hook member 110 is attached to the first end 90 of the support bar 70 and a stop pin 120 extends outwardly from a first surface 130 of the support bar 70. The elongated retainer sleeve 80 is adapted to receive the support bar 70, and together with the catch plate 50 form a housing 85 (best shown in FIGS. 3 and 4) within which the support bar 70 reciprocates from an extended position (illustrated in FIG. 3) to a retracted position (illustrated in FIG. 4).

In a preferred embodiment illustrated in FIG. 2, the retainer sleeve 80 comprises a U-shaped channel 140 having outwardly extending flanges 150*a*, 150*b* on opposite sides thereof which form coplanar mounting surfaces 160*a*, 160*b*. U-shaped channel 140 has a depth, D, which is slightly greater than the thickness, T, of the slidable support bar, 70. Stop pin 120 extends outwardly from the first surface 130 of support bar 70 at a distance, d, approximately equal to the thickness, t, of catch plate 50. These spacial relationships insure that the drop-leaf table extension 20, when in the horizontal position (FIGS. 1 and 3), butts up against the outer edge of tabletop 15 so that the two surfaces, i.e., the top surface 21 of drop-leaf table extension 20 and the top surface 16 of tabletop 15 lie essentially within the same plane.

The catch plate 50 and retainer sleeve 80 of housing 85 are adapted to be mounted to the underside of tabletop 15. As illustrated in FIG. 2, preferably the catch plate 50 and the mounting surfaces 160*a*, 160*b* of elongated retainer sleeve 80 have corresponding mounting holes 170*a*, 170*b*, and 170*a'*, 170*b'*, etc. which are aligned along the same vertical axis. Fasteners (not shown) extend through mounting holes 170*a*, 170*b*, and 170*a'*, 170*b'*, etc. and attach housing 85 to the underside of tabletop 15.

Figure 3:
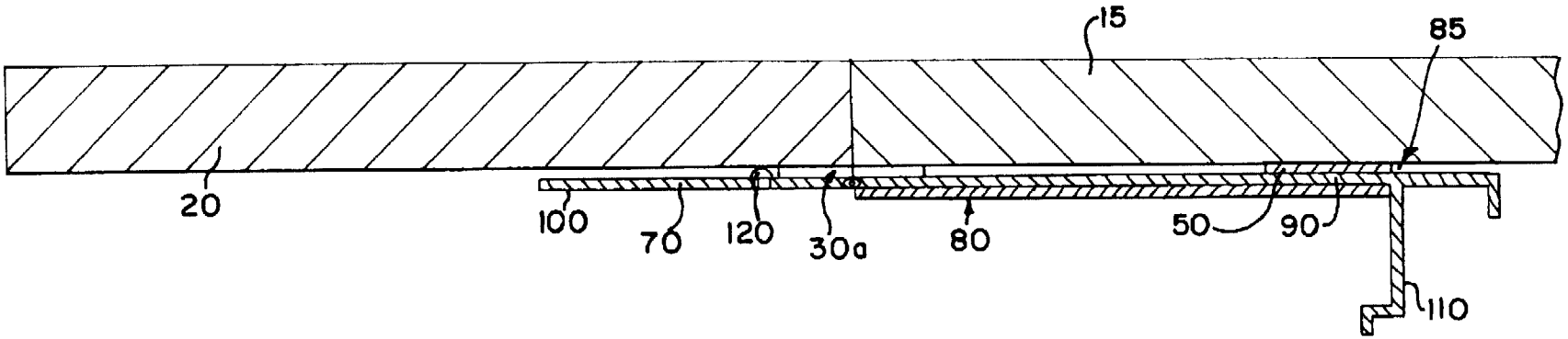
FIG. 3 is a partial cross-sectional view of the table in FIG. 1 taken along line 3—3; and, FIG. 4 illustrates the table in FIG. 3 with the drop-leaf table extension in a folded and locked position.
Figure 4:
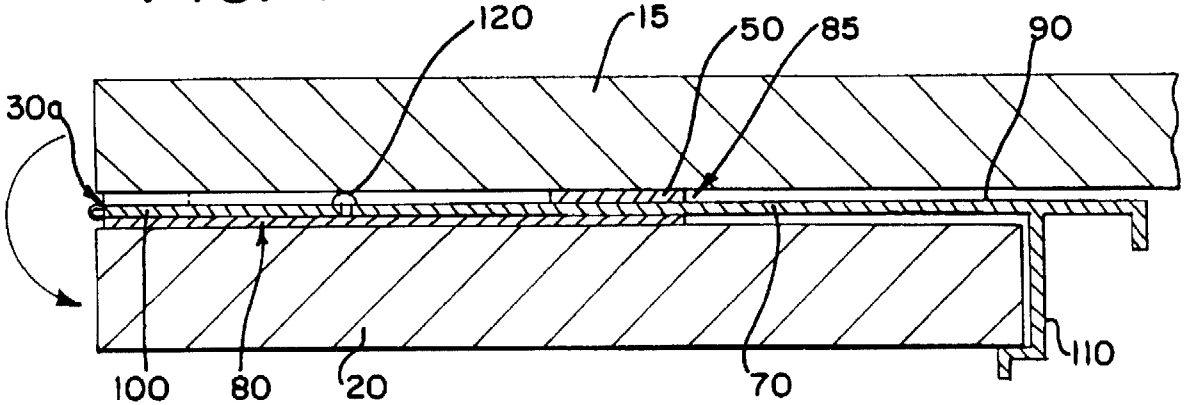

Referring now to FIGS. 3 and 4, the slidable support bar 70 reciprocates within housing 85 from an extended position (illustrated in FIG. 3) to a retracted position (illustrated in FIG. 4). When in the extended position, the second end 100 of support bar 70 extends from housing 85 and supports drop-leaf table extension 20 in a horizontal position. When in the retracted position, hook member 110 locks drop-leaf table extension 20 in a folded position.

In the preferred embodiment illustrated in FIG. 2, stop pin 120 extends outwardly from first surface 130 of support bar 70 closer to the second end 100 than the first end 90 of support bar 70, thus, insuring that support bar 70 may retract far enough within housing 85 to allow the drop-leaf table extension 20 to be folded into a position parallel to the underside of tabletop 15. At this point, support bar 70 may be slid forward until hook member 110 engages the outer edge of drop-leaf table extension 20, thus, locking drop-leaf table extension 20 in a folded position for storage.

While drop-leaf table extension 20 may be connected to tabletop 15 via any conventional connecting means, drop-leaf table extension 20 is preferably connected by a hinge or plurality of hinges, especially by what are commonly known in the industry as a butt hinge or a continuous hinge. As best shown in FIGS. 1 and 2, hinges 30*a* and 30*b* include an interlocking knuckle 180*a*, 180*b* with outwardly extending flanges 181*a*, 182*a* and 181*b*, 182*b* on opposite sides thereof which form coplanar mounting surfaces 185*a*, 185*b* and 186*a*, 186*b*. Coplanar mounting surfaces 185*a*, 185*b* and 186*a*, 186*b* are adapted for mounting to the underside of both drop-leaf table extension 20 and tabletop 15 and preferably include a plurality of mounting holes 187*a*, 187*b*, 188*a*, 188*b*, etc. The height, H, of knuckle 180*a*, 180*b* should be at least approximately equal to the depth, D, of U-shaped channel 140. This allows the drop-leaf table extension 20 to be essentially parallel to the underside of tabletop 15 in the folded position.

What I claim is:

1. A slidable locking mechanism for supporting a drop-leaf table extension to a tabletop, the mechanism comprising:

(a) a catch plate having material removed to define an elongated groove;

(b) an elongated slidable support bar having first and second ends, a hook member attached at the first end and a stop pin extending outwardly from a first surface of the support bar, the stop pin slidably engaged within the elongated groove of the catch plate; and, (c) an elongated retainer sleeve which receives the support bar, the retainer sleeve and the catch plate forming a housing within which the slidable support bar reciprocates from an extended position to a retracted position, where in the extended position the second end of the slidable support bar extends from the housing and supports the drop-leaf table extension in a horizontal position and when in the retracted position the hook member engages an outer edge of the drop-leaf table extension when the drop-leaf table extension is in a folded position, the housing being adapted to be mounted to the underside of the tabletop.

2. The slidable locking mechanism of claim 1, wherein the elongated retainer sleeve comprises a U-shaped channel having outwardly extending flanges on opposite sides thereof which form coplanar mounting surfaces.

3. The slidable locking mechanism of claim 2, wherein the U-shaped channel has a depth slightly greater than the thickness of the slidable support bar.

4. The slidable locking mechanism of claim 1, wherein the catch plate and the elongated retainer sleeve have corresponding mounting holes which are aligned along the same vertical axis.

5. The slidable locking mechanism of claim 1, wherein the catch plate has a thickness and the stop pin extends outwardly from a first surface of the slidable support bar at a distance approximately equal to the thickness of the catch plate.

6. The slidable locking mechanism of claim 1, wherein the stop pin extends outwardly from the first surface of the support bar closer to the second end of the support bar than the first end of the support bar.

7. A table comprising:

(a) a tabletop;

(b) at least one drop-leaf table extension connected to the tabletop;

(c) a catch plate having material removed to define an elongated groove;

(d) an elongated slidable support bar having first and second ends, a hook member attached at the first end and a stop pin extending outwardly from a first surface of the support bar, the stop pin slidably engaged within the elongated groove of the catch plate; and, (e) an elongated retainer sleeve which receives the support bar, the retainer sleeve and the catch plate form a housing within which the slidable support bar reciprocates from an extended position to a retracted position, when in the extended position the second end of the slidable support bar extends from the housing and supports the drop-leaf table extension in a horizontal position and when in the retracted position the hook member engages an outer edge of the drop-leaf table extension when the drop-leaf table is in a folded position, the housing being adapted to be mounted to the underside of the tabletop.

8. The table of claim 7, wherein a hinge connects the drop-leaf table extension to the tabletop.

9. The table of claim 8, wherein a butt hinge connects the drop-leaf table extension to the tabletop, the hinge including an interlocking knuckle having outwardly extending flanges on opposite sides thereof which form coplanar mounting surfaces.

10. The table of claim 9, wherein the interlocking knuckle of the butt hinge has a height and the elongated retainer sleeve includes a U-shaped channel having a depth, the height of the knuckle being at least approximately equal to the depth of the U-shaped channel.

11. The table of claim 8, wherein a continuous hinge connects the drop-leaf table extension to the tabletop, the hinge including an interlocking knuckle having outwardly extending flanges on opposite sides thereof which form coplanar mounting surfaces.

12. The table of claim 7, wherein the elongated retainer sleeve comprises a U-shaped channel having outwardly extending flanges on opposite sides thereof which form coplanar mounting surfaces.

13. The table of claim 12, wherein the U-shaped channel has a depth greater than the thickness of the slidable support bar.

14. The table of claim 7, wherein the catch plate and the elongated retainer sleeve have mounting holes which are aligned along the same vertical axis.

15. The table of claim 7, wherein the catch plate has a thickness and the stop pin extends outwardly from a first surface of the slide bar at a distance approximately equal to the thickness of the catch plate.

16. The table of claim 7, wherein the stop pin extends outwardly from the first surface of the support bar closer to the second end of the support bar than the first end of the support bar.

17. A slidable locking mechanism for supporting a drop-leaf table extension to a tabletop, the mechanism comprising:

(a) an elongated slidable support bar having first and second ends (b) a hook member attached at the first end of said slidable support bar; and, (c) an elongated retainer sleeve comprising a channel mounted to the underside of the tabletop, wherein the channel of the retainer sleeve receives the slidable support bar, the slidable support bar reciprocates from an extended position to a retracted position, where in the extended position the second end of the slidable support bar extends from the housing and supports the drop-leaf table extension in a horizontal position and when in the retracted position the hook member engages an outer edge of the drop-leaf table extension when the drop-leaf table extension is in a folded position.

18. A table comprising:

(a) a tabletop;

(b) at least one drop-leaf table extension connected to the tabletop;

(c) an elongated slidable support bar having first and second ends;

(d) a hook member attached at the first end of the slidable support bar; and, (e) an elongated retainer sleeve comprising a channel mounted to the underside of the tabletop, wherein the channel of the retainer sleeve receives the slidable support bar, the slidable support bar reciprocates from an extended position to a retracted position, when in the extended position the second end of the slidable support bar extends from the housing and supports the drop-leaf table extension in a horizontal position and when in the retracted position the hook member engages an outer edge of the drop-leaf table extension when the drop-leaf table is in a folded position.

* * * * *